United States Patent [19]
Redmond et al.
[11] 4,099,466
[45] Jul. 11, 1978

[54] TRAJECTORY ADAPTIVE SAFETY-ARMING DEVICE

[75] Inventors: Stephen L. Redmond, Ridgecrest; James E. Means, China Lake; Michael R. Osburn, Ridgecrest, all of Calif.

[73] Assignee: The United States of America as represented by the Secretary of the Navy, Washington, D.C.

[21] Appl. No.: 793,998

[22] Filed: May 5, 1977

[51] Int. Cl.[2] ..... F42C 15/40
[52] U.S. Cl. ..... 102/215; 102/255
[58] Field of Search ..... 102/70.2 R

[56] References Cited

U.S. PATENT DOCUMENTS

| | | | |
|---|---|---|---|
| 2,872,538 | 2/1959 | McLean | 102/70.2 R |
| 2,912,933 | 11/1959 | Rabinow | 102/70.2 R |
| 2,915,013 | 12/1959 | Moorhead, Jr. | 102/70.2 R |
| 3,066,605 | 12/1962 | Jones et al. | 102/70.2 R |
| 3,306,207 | 2/1967 | Becker et al. | 102/70.2 R |
| 3,368,487 | 2/1968 | O'Connor et al. | 102/70.2 R |
| 3,498,225 | 3/1970 | Voida et al. | 102/70.2 R |
| 3,554,128 | 1/1971 | Hoelzen et al. | 102/70.2 R |
| 3,613,589 | 10/1971 | Apstein | 102/70.2 R |
| 3,672,302 | 6/1972 | Shaw | 102/70.2 R |
| 3,750,583 | 8/1973 | White et al. | 102/70.2 R |
| 3,841,220 | 10/1974 | Murphy | 102/70.2 R |
| 3,890,901 | 6/1975 | Anderson et al. | 102/70.2 R |
| 4,019,441 | 4/1977 | Morgen et al. | 102/70.2 R |
| 4,036,144 | 7/1977 | Meek | 102/70.2 R |

*Primary Examiner*—Charles T. Jordan
*Attorney, Agent, or Firm*—R. S. Sciascia; Roy Miller; T. W. Hennen

[57] ABSTRACT

A safety-arming device for use in a highly maneuverable missile is disclosed which takes into account lateral acceleration of the missile and selects the proper point in the trajectory after which arming of the missile warhead may safely proceed. The safety-arming device uses a series of electrical, mechanical, and electromechanical interlocks to insure that premature arming of the missile warhead does not occur.

10 Claims, 10 Drawing Figures

LOCKED IN POSITION PRIOR TO LAUNCH (SAFE)

G-MASS UNLOCKED

EXPLOSIVE ROTOR UNLOCKED

ARMED AND LOCKED

TRAJECTORY ADAPTIVE SAFETY-ARMING DEVICE

BACKGROUND OF THE INVENTION

1. Field of the Invention

The trajectory adaptive safety-arming device disclosed herein pertains to mechanical devices which will maintain a guided missile warhead in an unarmed condition during all handling, storage, and aircraft flight conditions, but will arm the missile after it has been launched and a minimum separation distance has occured between the missile and the launching aircraft. Arming of the missile constitutes mechanical alignment of the most sensitive explosive elements (detonators) with the explosive train which leads to the high explosive warhead, and closing electrical switches between the firing circuit and detonators. More particularly, this safety-arming device utilizes lateral acceleration sensors and digital electronic circuitry to take lateral acceleration into account and thereby prevent arming of the missile before it has achieved a minimum separation distance because of steep turning maneuvers executed immediately after launch.

2. Description of the Prior Art

Current guided missile safety-arming devices measure either a fixed time interval or approximate distance from launch before arming. These two methods have been sufficient to insure that the missile was a safe distance away from the launch aircraft as long as the missile flew nearly straight ahead during the initial part of its flight. However, future missiles will have the ability to execute highly curved trajectories shortly after launch. Such a trajectory results in very high lateral acceleration levels being applied to the missile and its safety-arming device. Furthermore, future missiles are going to be required to engage enemy aircraft at close ranges. Therefore, the guided missile safety-arming device must provide for adequate separation from the launch aircraft before arming, but it must not limit the minimum launch range.

In order to meet this criteria, there must be a very accurate variable point at which arming will occur. Also, the safe separation point where warhead detonation will not cause unacceptable damage to the launch aircraft is a complex function of the relative positions, velocities, and orientations of the missile and launch aircraft. Therefore, the safe separation point is different for each type of trajectory flown. The safety arming device must be able to sense the type of trajectory which the missile is flying and adjust its arming point accordingly.

Previous safety-arming devices, which are predominately mechanical, are unacceptable in a missile which may undergo extreme lateral acceleration because these devices only integrate missile longitudinal acceleration which will result in an incorrect computation of missile separation distance and therefore possible early arming. The device described in this disclosure provides for (1) variable arming points, (2) sufficient accuracy to hit the "window" between the safe separation range and minimum target encounter range, and (3) operation under the severe lateral acceleration environments which are expected in highly maneuverable missiles.

SUMMARY OF THE INVENTION

The present invention overcomes the limitations of the prior art by providing a sequence of both mechanical and electronic events which must occur before arming may proceed. Upon an intent-to-launch signal given by the pilot, a solenoid is energized and rotates a first rotor to unlock a pair of sliding masses. Missile longitudinal acceleration drives the masses to one end of the safety arming device housing, and simultaneously stores energy in a spring attached to the explosive rotor. The second sliding mass is mechanically delayed by a flywheel, and as such serves to double integrate acceleration with respect to time to measure a minimum separation distance. An electric timer, which was started by initial set back of the first sliding mass, determines the point in time at which arming should occur, based upon inputs related to lateral acceleration and missile trajectory. The timer sends a signal to an electro-mechanical device, such as a solenoid, to arm the mechanism at the proper point in time. As the solenoid rotates the first rotor, the first rotor releases the explosive rotor which is rotated to the armed position by the spring which is attached to the first sliding mass. After the explosive rotor has been rotated to the armed position, the solenoid continues to rotate the first rotor and lock the mechanism in the armed position.

BRIEF DESCRIPTION OF THE DRAWING

Further advantages of the present invention will emerge from a description which follows of a possible embodiment of a trajectory adaptive safety-arming device according to the invention, given with reference to the accompanying drawing figures, in which:

FIG. 44 illustrates a mechanical block diagram of the arming sequence utilized in a trajectory adaptive safety-arming device according to the invention.

DESCRIPTION OF THE PREFERRED EMBODIMENT

Figure 1A:
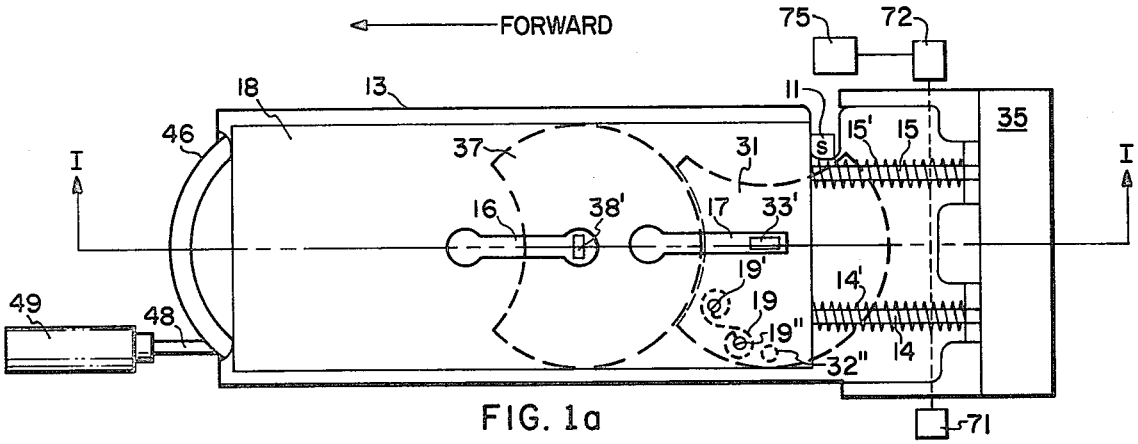
FIG. 1*a* illustrates a top view, partially in phantom, of a trajectory adaptive safety-arming device according to the invention.
Figure 1B:
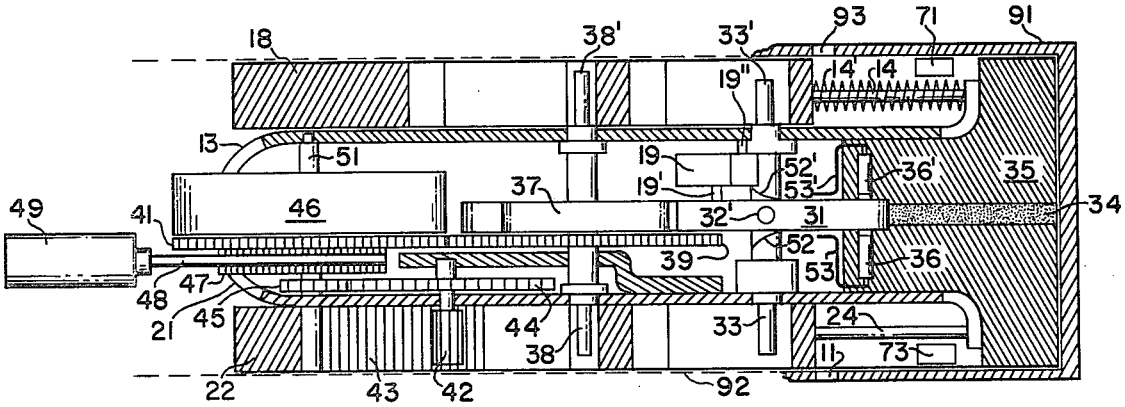
FIG. 1*b* illustrates a side view, partially in section, along line 1—1 of FIG. 1*a,* of a trajectory adaptive safety arming device according to the invention.
Figure 1C:
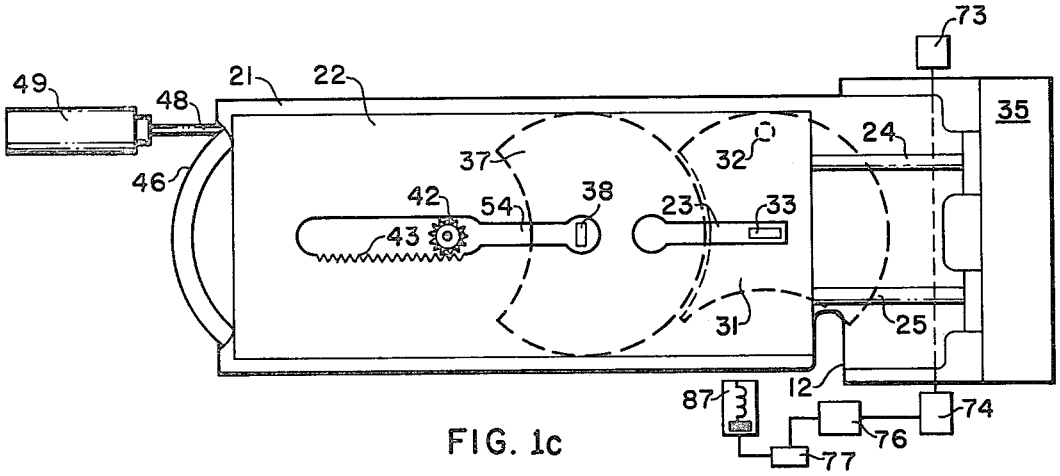
FIG. 1*c* illustrates a bottom view, partially in phantom, of a trajectory adaptive safety-arming device according to the invention.

Generally referring to all of the figures, wherein like reference numerals correspond to like parts and elements throughout the several views, there is shown particularly in FIG. 1 a representative embodiment of a trajectory adaptive safety-arming device. The parts of the device are mounted upon upper frame 13 and lower frame 21 which are spaced apart at the aft end by output block 35. G-mass 18 and pacer mass 22 slide longitudinally along frames 13 and 21 respectively, and are guided by g-mass guide rods 14 and 15 and pacer mass guide rods 24 and 25. G-mass 18 is resiliently biased by biasing springs 14' and 15'. The mechanical portions of the trajectory adaptive safety-arming device are designed to fit within housing envelope 92 when assembled so that the device will fit within housing 91.

Figure 2:
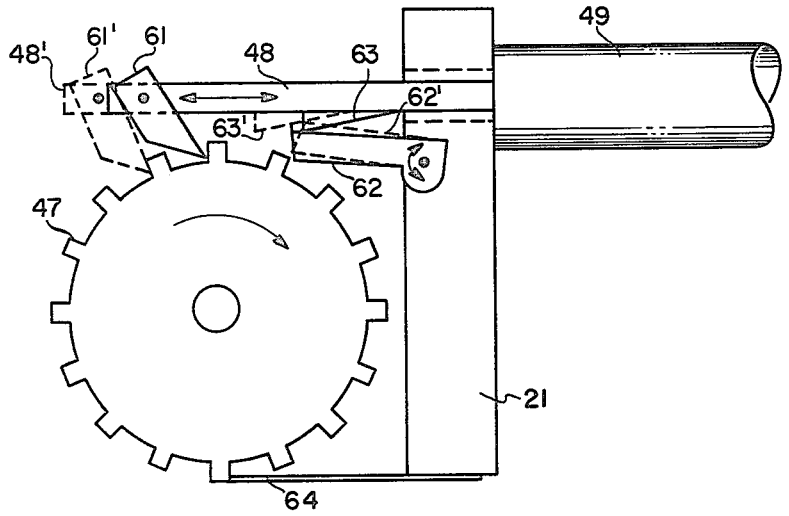
FIG. 2 illustrates the ratchet mechanism utilized in a trajectory adaptive safety-arming device according to the invention.

A more detailed description of the device will follow after explanation of the ratchet mechanism and interlocking rotors. Referring now to FIG. 2 there is shown linear solenoid 49, ratchet arm 48, ratchet 62, ratchet operator 63, antireversing detent 64, and ratchet cogwheel 47. Upon receipt of a driving signal, linear solenoid 49 alternates between the energized and deenergized conditions. This causes ratchet arm 48 to extend to the position shown as 48' and return to the position shown by arm 48. Pawl 61 follows arm 48, and in doing so, advances one cog on cogwheel 47. As arm 48 extends, ratchet operator 63 moves to position 63' permitting ratchet 62 to move toward position 62'. As arm 48 begins to return, pawl 61 advances cogwheel 47 in the clockwise direction. As arm 48 nears the retracted position, ratchet operator 63, which has a ramp-like configuration, contacts ratchet 62 and causes it to engage cogwheel 47 to permit only limited angular rotation. As ratchet arm 48 extends in the next cycle and causes pawl 61 to drag over an adjacent cog, antireversing detent 64 engages a cog and prevents reverse rotation of cogwheel 47.

Referring now to FIG. 3 there is shown the mechanical interlocks used in the present invention. G-mass 18 is shown in FIG. 3*a* in the locked position prior to launch. It is noted that interlock rotor 37 is positioned so that upper key 38' is broadside to G-mass interlock rotor slot 16 in pre-launch expanded end 16''. Also, it is seen that explosive rotor 31 is held against rotation by the surface of interlock rotor 37, and explosive rotor upper key 33' is aligned parallel to G-mass explosive rotor slot 17.

Figure 3A:
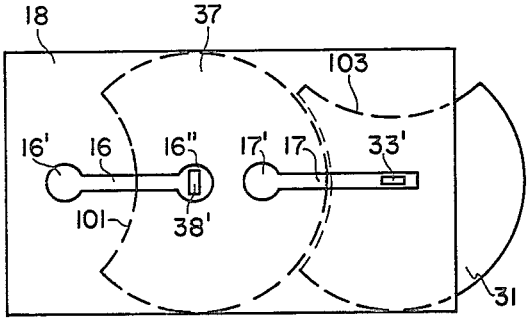
FIGS. 3*a*–3*d* illustrate the mechanical interlock utilized in a trajectory adaptive safety-arming device according to the invention.
Figure 3B:
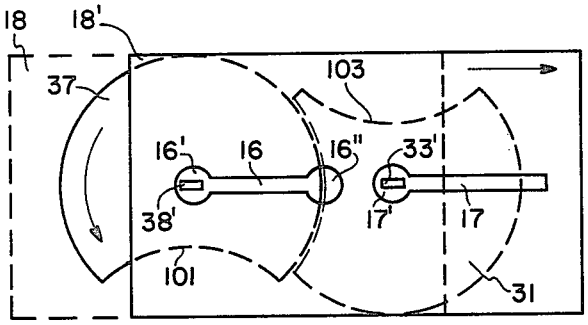
Figure 3C:
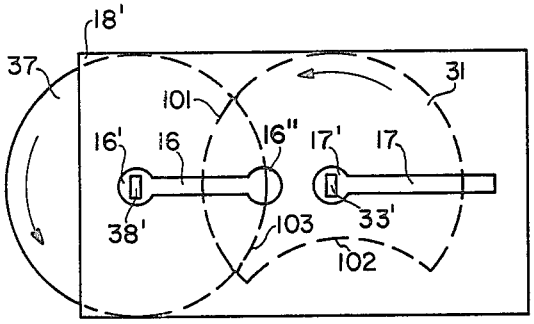
Figure 3D:
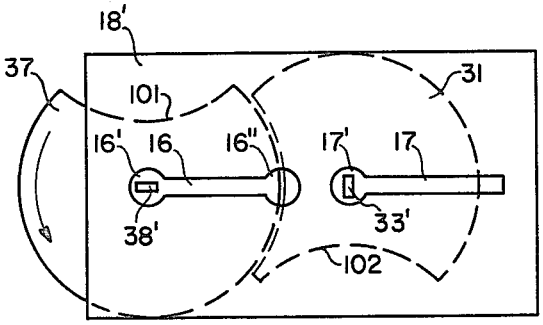

In FIG. 3*b* it is noted that interlock rotor 37 has rotated 90° counter clockwise thereby aligning key 38' with slot 16. This has unlocked G-mass 18 which has moved to position 18' under the influence of longitudinal missile acceleration. Also, key 33' on explosive rotor 31 now occupies expanded end 17' of slot 17. In FIG. 3*c* interlock rotor 37 has again been rotated counter clockwise 90°, aligning interlock rotor concave face 101 with explosive rotor 31 thereby permitting explosive rotor 31 to rotate 90° counter clockwise under the influence of energy stored in the spring 19 (shown in FIG. 1) until explosive rotor concave surface 103 is aligned with interlock rotor 37. Finally, in FIG. 3*d* interlock rotor 37 has again rotated 90° counter clockwise to lock explosive rotor 31 in the armed position.

Over-rotation of explosive rotor 31 is prevented by appropriate placement of suitable stops (not shown) which cause explosive rotor 31 to align surface 103 accurately and concentrically with interlock rotor 37. The relative positions of keys 33' and 38' lock G-mass 18 in position 18' throughout the various stages of the arming procedure, as is shown by FIG. 3. Explosive rotor surface 102, which initially serves to lock explosive rotor 31 in the safe position, ends the sequence position 90° to interlocking rotor 37 and serves no other function when explosive rotor 31 rotates to the armed position.

The ratchet mechanism illustrated in FIG. 2 causes arm 48 to retract when linear solenoid 49 is energized, and to extend to position 48' under the influence of a return spring (not shown) when solenoid 49 is deenergized. Accordingly, pawl 61 and ratchet operator 63 assume position 61' and 63' respectively as solenoid 49 is deenergized. Finally, ratchet 62 assumes position 62' when solenoid 49 is deenergized. Upon applying electrical energy to solenoid 49, arm 48 begins its travel from position 48' to position 48 and pawl 61' engages the cogs of cogwheel 47 and drives cogwheel 47 in a clockwise direction. Pawl 61' drives cogwheel 47 until the ratchet operator 63' forces ratchet 62 into the cogs of cogwheel 47 and terminates its rotation at 22.5°. Solenoid 49 is then deenergized and the spring biased ratchet mechanism returns to the original position defined by primed reference numerals in FIG. 2. Anti-reverse detent 64 prevents the rotation of cogwheel 47 in the counter clockwise direction during the deenergizing phase of the cycle.

In operation, solenoid 49 drives interlock rotor 37 through a 1:1 transfer gear stage made up of ratchet gear 41 and interlock rotor gear 39. Interlock rotor 37 has upper and lower keys 38' and 38 which engage slots 16 and 54 on G-mass 18 and pacer mass 22 respectively. Upon intent-to-launch, solenoid 49 receives 4 pulses of electrical energy which causes solenoid 49 to cycle 4 times. This causes ratchet gear 41 and interlock rotor gear 39 to rotate 90°, thereby aligning keys 38' and 38 with slots 16 and 54. This action releases both the G-mass 18 and pacer mass 22. If longitudinal missile acceleration of sufficient magnitude is present, G-mass 18 will bottom against bias springs 14' and 15'. This removes a first key interlock on explosive rotor 31, and stores energy in constant force (negator) spring 19 which extends between G-mass spring post 19'' and explosive rotor spring post 19'. Energy thus stored in negator spring 19 is later used to rotate explosive rotor 31 to the armed position.

The bottoming of G-mass 18 breaks a beam of light transmitted by G-mass light source 71 to G-mass light sensor 72 which signals this information to clock 75. Source 71 and sensor 72 may be a light emitting diode-photo diode circuit or any other equivalent structure. At the same time that G-mass 18 is bottoming under the influence of longitudinal acceleration, pacer mass 22 also is being influenced by acceleration. Gear rack 43 on pacer mass 22 meshes with pacer pinion 42 and causes pinion 42 to rotate as pacer mass 22 approaches the bottomed position. Pinion 42, in turn, is rigidly attached to gear stage 44 and causes it to rotate also. Gear stage 44 meshes with flywheel gear 45 which is rigidly attached to flywheel shaft 51. Flywheel shaft 51 transmits rotation to flywheel 46 so that as pacer mass 22 moves toward the bottomed position, pinion 42, through large gear stage 44 and small flywheel gear 45, causes flywheel 46 to accelerate. This acceleration of flywheel 46 retards translation of pacer mass 22. Gear stage 44 and flywheel gear 45 are sized to provide approximately a 7.5:1 gear ratio.

When pacer mass 22 reaches the bottomed position, interlock rotor 37 is again free to rotate, and key 33 on explosive rotor 31 likewise has entered enlarged end of pacer mass slot 23. Flywheel 46 is driven by missile forward acceleration and in this way prevents pacer mass 22 from bottoming until a minimum preselected time interval corresponding to a minimum separation distance, has occurred, and also provides a positive indication that an actual launch has taken place. As pacer mass 22 completes its travel, a second light source 73 and light sensor 74 which may be constructed equivalent to source 71 and sensor 72, and which are coupled to counter 76, indicate that pacer mass 22 has in fact completed its travel.

As the missile is launched, lateral acceleration is sensed by suitable acceleration sensors 87, and this information is input to a digital electronic circuit 77 which communicates with counter circuit 76. When circuit 76 has been informed that pacer mass 22 has completed its travel and that an arming time based upon lateral acceleration undergone by the missile has been selected, counter circuit 76 causes a signal to be sent which cycles solenoid 49 four times, resulting in rotation of ratchet gear 41 and interlock rotor 37 through an angle of 90°. At this time the energy stored in spring 19 is released and explosive rotor 31 is driven to the armed position. A set of brushes 52 and 52', attached to explosive rotor 31, complete the circuit between the firing circuit and detonators 36 and 36'. Finally, four more pulses from counter circuit 76 cause solenoid 49 to rotate cogwheel 47 and ratchet gear 41 which in turn rotates interlock rotor 37 to the final position, locking explosive rotor 31 in the armed position.

Incorporated in the device is viewing window 93 which, when the device is assembled, aligns with safe condition indicator window 12. When the device is experiencing no acceleration, and explosive rotor 31 is in the safe position, no internal component will obstruct the view through housing 91 via window 93 of safe condition indicator 11. When an obstruction is present, the device is not fully safe. The obstruction will be any one of three components; G-mass 18, pacer mass 22, or explosive rotor 31. As an added safety feature, if forward acceleration is not present at the time of arming, then no energy will be stored in constant force spring 19 and explosive rotor 31 will not rotate into alignment.

When explosive rotor 31 has moved to the armed position, explosive elements 32 and 32'' are aligned with detonators 36 and 36' respectively, and explosive element 32' is alligned with explosive train 34, completing the explosive circuit.

DESCRIPTION OF ELECTRONIC CIRCUITRY

The trajectory adaptive safety-arming device electronic circuitry uses digital logic to produce an arming time delay and apply a definite number and sequence of pulses to solenoid 49. Power-on reset circuit 81 applies a reset pulse to all flip flop and counter circuits in the circuitry of the device when missile battery voltage comes up to a minimum level. The reset pulse causes all flip flops and counters to go to Q and zero states respectively. This reset pulse will also be applied if at any time during the flight the battery voltage level drops below a preselected minimum value.

Clock 75 is an R-C oscillator which feeds pulses to both counter 76 and sequencer 78. Clock 75 is gated on or off at various times by power-on reset 81, G-mass light sensor 72, or counter 76. Counter 76 is a binary up-counter which determines the arming times and destruct time. Counter 76 is also used to divide clock 75 pulses for use in activating solenoid 49 through sequencer 78. Counter 76 is set by inputs that determine which arming time is desired, and counter 76 is also controlled because before an arming signal can occur, a pacer mass completion signal must be received by counter 76. Sequencer 78 applies pulses to solenoid driver 79, applies initial pulses at the end of the power-on reset cycle, and applies the proper number and sequence of pulses when the desired arming point is reached. Solenoid driver 79 is a solid state relay which takes low power pulses from sequencer 78 and delivers high power pulses to drive solenoid 49.

TRAJECTORY ADAPTIVE SAFETY ARMING SEQUENCE

It is not practical to provide the desired accuracy or flexibility in selection of arming point in a highly manueverable missile using a purely mechanical device, particularly in light of the severe lateral maneuvers which a missile is capable of performing. The safety-arming device of this invention requires that a specific number and duration of electrical pulses be applied to solenoid 49, along with the removal at the proper time, of mechanical interlocks before arming can occur. The technique of using interrelated electronic and mechanical events is intended to prevent an early armed missile warhead or other safety hazard due to a failure in the missile electronics. Previous missile safety-arming devices do not have this problem because of their pure mechanical sequence, but because of the lateral acceleration environment and necessity for selecting arming times during flight, a hybrid mechanical-electronic concept is necessary.

Figure 4:
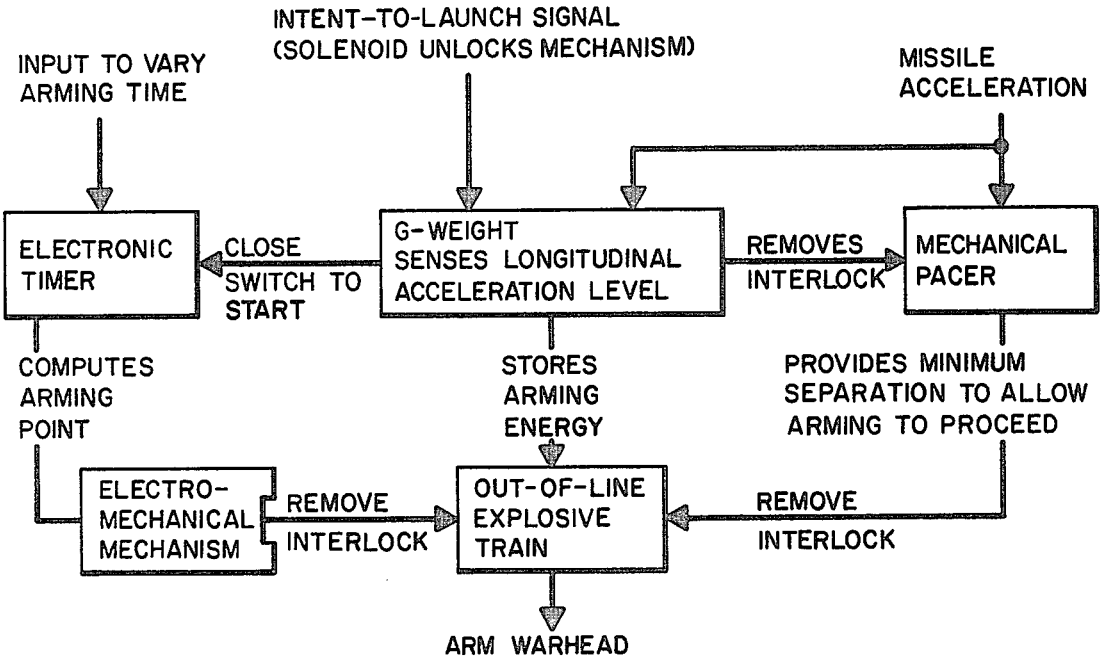
Figure 5:
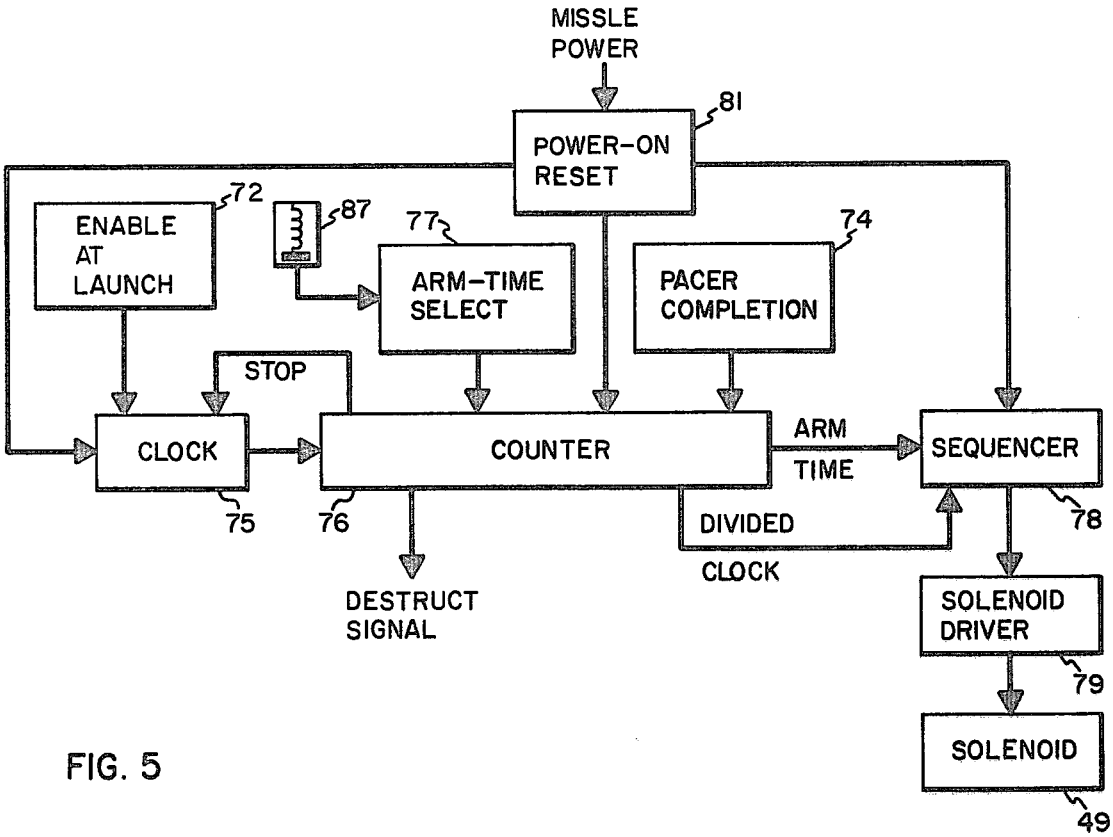
FIG. 5 illustrates a block diagram of the electronic circuitry utilized in a trajectory adaptive safety-arming device according to the invention.

As shown in FIGS. 4 and 5, an intent-to-launch signal causes missile power to come on, and clock 75 to send pulses to counter 76. Counter 76 divides these pulses and periodically applies a pulse to solenoid 49 until a sequence of 4 pulses has been sent, after which clock 75 is turned off.

Once the missile has been launched, two parallel actions begin. A mechanical pacer, which is driven by missile acceleration, measures a few hundred feet of travel and then gives an armed enable signal to counter 76. Also counter 76 again begins to accumulate pulses from clock 75. At some point early in the missile flight, inputs are received by counter 76 from acceleration sensors 87 located at various points in the missile to determine which one of several possible arming times should be selected. Thus counter 76 now knows at what time it should start the final arming sequence. When that time is reached, a series of four pulses (obtained by dividing pulses from clock 75 in counter 76) is sent to solenoid 49 via sequencer 78 and driver 79. These pulses must be at least 15 milliseconds in duration in order to cause cogwheel 47 to ratchet forward. If the pulse is less than 15 milliseconds, the mechanical system will not actuate because of its inertia. Once the explosive train is aligned, a final series of four pulses is sent to solenoid 49 to lock explosive rotor 31 in the armed position.

Requiring a particular sequence of electrical pulses in order to achieve proper alignment of the explosive train serves to provide safety during the portion of missile flight from completed mechanical pacer travel until a final safe separation point has been reached. Since the only locks which haven't been removed at this point are those which require electrical signals, it is proposed that a specific sequence of pulses is far less likely to be inadvertently introduced than a single electrical pulse, particularly if in order to achieve that specific sequence, the electronics must be working properly. Also, a burst of electronic noise or electromagnetic radiation is far less likely to cause arming than if only a single pulse were needed.

Another mode of failure which one might consider is that of the clock running at too high a frequency. In this case, the divided pulses to solenoid 49 would not be of sufficient duration to cause forward ratcheting of the arming and interlock rotors. The final mode of failure is that of an early arming signal occuring from the binary up counter. However, the proper sequence of signals is required from the counter, and therefore a single component failure alone cannot initiate the proper arming sequence.

A runaway (verge) escapement can be used in place of the pacer and flywheel integrator system if desired. A second solenoid could be used to drive the explosive rotor instead of spring 19.

What is claimed is:

1. A safety-arming device having a variable arming point for use in a maneuvering, explosive missile, comprising:

an explosive path having an element which is movable between unarmed and armed positions;

acceleration responsive means operable to detect missile acceleration in the longitudinal direction and in at least one lateral direction, and operable to generate an output signal in response to said missile acceleration;

integrating means coupled to said acceleration responsive means and operable to compute missile displacement in response to said output signal;

logic means coupled to said integrating means, said logic means being operable to compare said computed missile displacement with a predetermined minimum missile displacement, and to send an arming signal if said predetermined minimum displacement is exceeded by said computed displacement; and means responsive to said arming signal for moving said explosive path element from said unarmed position to said armed position.

2. A safety-arming device as set forth in claim 1 wherein said explosive path comprises:

at least one electrically initiated detonator;

said movable explosive path element defining a rotating member having at least one passageway having first and second ends;

an output block defining a corridor having first and second ends;

detonatable material filling said passageway and filling said corridor;

said first end of each passageway being spaced from a detonator if said movable explosive path element is in said unarmed position, and adjacent a detonator if said movable element is in said armed position; and said second end of each passageway being spaced from said first end of said corridor if said movable explosive path element is in said unarmed position, and adjacent said first end of said corridor if said movable explosive path element is in said armed position.

3. A safety-arming device as set forth in claim 1 wherein said acceleration responsive means comprises a longitudinal acceleration sensor and a plurality of lateral acceleration sensors.

4. A safety-arming device as set forth in claim 1 wherein said integrating means comprises an electric circuit for computing the distance between a missile and a launching platform.

5. A safety-arming device as set forth in claim 1 wherein said logic means comprises an electric circuit for arming said missile if a predetermined separation distance between the missile and a launching platform is established.

6. A safety-arming device as set forth in claim 1 wherein said means for moving said explosive path element comprises:

a first mass resiliently positioned to respond inertially to longitudinal acceleration in said missile;

a second mass positioned to respond inertially to longitudinal acceleration in said missile;

retarding means operable to delay said inertial response to said second mass;

resilient means operably connected between said first mass and said movable explosive path element for urging said element toward said armed position in response to said inertial response to said first mass;

means associated with said first and second masses and said movable explosive path element and responsive to a predetermined acceleration for enabling said element to move from said unarmed position to said armed position; and releasable interlock means responsive to said logic arming signal for enabling said movable explosive path element to move from said unarmed position to said armed position.

7. A safety-arming device as set forth in claim 6 wherein said retarding means comprises:

said second mass being restrained to translation along a line which is parallel to the longitudinal axis of said missile, and having a plurality of rack gear teeth formed parallel to said line on a surface of said second mass; and a flywheel mounted for rotation about an axis and coupled to a gear which has teeth operably engaging said rack gear teeth on said second mass;

so that longitudinal acceleration of said missile will cause said second mass to respond inertially, causing said rack gear teeth to rotate said gear and accelerate said flywheel.

8. A safety-arming device as set forth in claim 6 wherein said resilient means comprises a constant force arming spring.

9. A safety-arming device as set forth in claim 6 wherein said means associated with said first and second masses for enabling said element to move from said unarmed position to said armed position comprises:

said first and second masses being restrained to translation directed along lines which are parallel to the longitudinal axis of said missile;

said first mass defining a first elongated narrow width slot having an enlarged width slot region at each end of said first slot, and a second elongated narrow width slot having an enlarged width slot region at one end of said second slot;

said second mass defining an elongated narrow width slot having an enlarged width slot region at one end of said slot in said second mass corresponding to one of said enlarged width slot regions of said second elongated narrow width slot in said first mass;

each elongated narrow width slot in said first and second masses being parallel to said translation direction of said masses, and said corresponding enlarged width slot regions being located at the end of each of said narrow width slots which is positioned toward the front of said missile;

said movable explosive path element defining a first rotating member fixed for rotation about a first axis, and having a first shaft extending through said first rotating member along said first axis, said first shaft having first and second ends, each end of said first shaft defining a key, said first end of said shaft engaging said second narrow width slot in said first mass, and said second end of said shaft engaging said narrow width slot in said second mass; and a second rotating member fixed for rotation about a second axis and movable between first, second, third and forth positions, said second rotating member having a second shaft extending through said second rotating member along said second axis of rotation, said second shaft having first and second ends, each end of said second shaft defining a key, and one end of said second shaft engaging said first elongated narrow width slot in said first mass;

said keys on said first and second shafts each having a transverse section which is rectangular in form, having one dimension which is greater than said narrow slot width, and less than said enlarged region width, and one dimension which is less than said narrow slot width.

10. A safety-arming device as set forth in claim 9 wherein said releasable interlock means comprises:

said first and second axes of rotation being parallel and spaced apart;

said first rotating member having a disk-like body portion defined by a perimeter made up of a first segment which is concentric about said first axis of rotation and has a first radius, and two adjoining segments which each have a second radius, one of said adjoining segments being concentric about said second axis of rotation if said first rotating member is in said unarmed position, and the other adjoining segment being concentric about said second axis of rotation if said first rotating member is in said armed position;

said second rotating member having a gear concentric about said second axis of rotation, and a disk-like body portion defined by a perimeter made up of a first segment which is concentric about said second axis of rotation and has said second radius, and a second segment which has said first radius and is concentric about said first axis of rotation if said second rotating member is in said third position;

a third rotating member fixed for rotation about a third axis of rotation which is parallel to and spaced from said first and second axes of rotation, said third rotating member having a gear concentric about said third axis of rotation which operably engages said gear on said second rotating member, and said third rotating member having peripheral ratchet teeth;

a ratchet mechanism operably engaging said ratchet teeth on said third rotating member; and a solenoid responsive to said arming signal from said logic means and operably attached to said ratchet mechanism for causing said third rotating member to rotate.

* * * * *